United States Patent [19]

Rubin et al.

[11] Patent Number: 4,553,344

[45] Date of Patent: Nov. 19, 1985

[54] MULTIFRAME APPARATUS

[76] Inventors: Gene L. Rubin, 216 Sanhican Dr., Trenton, N.J. 08618; Anthony H. Filipowicz, 838 Park Ave., Trenton, N.J. 08629; Frank Valenza, 771 N. Clinton, Trenton, N.J. 08638

[21] Appl. No.: 598,049

[22] Filed: Apr. 9, 1984

[51] Int. Cl.[4] ..... A47G 1/00

[52] U.S. Cl. ..... 40/152; 40/152.1

[58] Field of Search ..... 40/152, 152.1, 155, 40/490

[56] References Cited

U.S. PATENT DOCUMENTS

| | | | |
|---|---|---|---|
| 1,251,791 | 1/1918 | Leeland | 40/152 |
| 1,892,492 | 12/1932 | Molner | 40/152 |
| 3,471,959 | 10/1969 | Seger | 40/152 |
| 3,523,382 | 8/1970 | Dreyer | 40/152 |
| 3,648,393 | 3/1972 | Parsilla | 40/152 |
| 3,869,829 | 3/1975 | Chiosso | 40/152 |
| 4,070,780 | 1/1978 | Rosenberg | 40/152 |
| 4,115,938 | 9/1978 | Belmuth et al. | 40/152 |

*Primary Examiner*—Robert P. Swiatek
*Assistant Examiner*—Cary E. Stone
*Attorney, Agent, or Firm*—Richard C. Woodbridge

[57] ABSTRACT

A multiframe apparatus includes a main frame for displaying four subframes in an attractive grouping. Each subframe is capable of standing independently supported by a removable stand. A collector plate or other similar item is framed within the subframe field. The four subframes include locking grooves in their sides and are arrangeable in a square pattern in the display field of the main frame. A slidable locking key passes through an aperture in the bottom of the main frame and engages the grooves in the four subframes so that they are locked securely in the main frame. The main frame includes a removable stand so that the multiframe apparatus can stand by itself. Alternatively the apparatus can be hung by a bracket from a wall. The multiframe apparatus allows the user to easily and selectively choose between displaying small items individually in the subframes or displaying the items as a collection by displaying all the subframes in the main frame. The apparatus lends itself especially to displaying items such as small collector plates which may be issued on an annual basis.

10 Claims, 12 Drawing Figures

MULTIFRAME APPARATUS

BACKGROUND OF THE INVENTION

1. Field of the Invention

The invention relates to a multiframe apparatus for displaying a plurality of subframes in an attractive grouping.

2. Description of the Prior Art

There are a number of devices known in the prior art for displaying multiple items in a group. For example, U.S. Pat. No. 3,523,382 discloses the use of a large frame which is adapted to receive a plurality of smaller subframes within its confines. A resilient clamp is used in each individual frame to hold a backing plate against a photographs. Individual frames are designed to be displayed singly, or in groups of two or more in the larger frame. Each of the subframes are attached to each other by means of resilient clips.

U.S. Pat. No. 4,115,938 discloses another system in which a plurality of frames can be arranged in groups and held together by means of clips.

U.S. Pat. No. 3,471,959 discloses another multiframe construction in which connecting members are used to connect adjacent frames or plaques together. Keyholes in the back of the adjacent frames may be used to hang the connected members together as a group.

U.S. Pat. Nos. 4,070,780 and 3,869,829 disclose other multi-picture frame devices employing other techniques for holding the elements together.

U.S. Pat. No. 3,468,393 is of interest in that it teaches the use of a male/female dovetail strip to interconnect adjacent picture frames having complimentary ridges and grooves.

U.S. Pat. No. 1,892,492 is of interest only in that it discloses a separate stand for supporting a single picture frame.

Lastly, U.S. Pat. No. 1,251,791 is of possible relevance in that it discloses the use of a name plate for association with a small photograph or picture or the like.

None of the prior art references hint, teach or suggest the improved multiframe apparatus that is the subject of this disclosure.

SUMMARY OF THE INVENTION

Briefly described the invention comprises a multiframe apparatus which includes a main frame for displaying four subframes in an attractive grouping. Each subframe typically includes a small name plate thereon and a decorative stripe down one edge thereof. A removable stand is attachable to each subframe so that each subframe can be displayed individually. The subframes are primarily employed for the purpose of displaying small collector plates and the like, however, other items could be displayed as well. The invention especially lends itself to the display of collectable items which are issued on an annual basis. Therefore the first collectable item in the series could be displayed by one or more subframes. Once the entire set of four collector plates has been received over a period of four years, then the entire set of four subframes can be displayed in the larger main frame. Each subframe includes a peripheral groove around the edge thereof. The subframes are arranged in a square pattern in the display field of the main frame. The grooves on the outside of the subframes engage with a peripheral rib running around the inside of the main frame. A slidable locking key is inserted into the main frame through an aperture in the bottom thereof and includes a locking rib which engages the grooves on the inside edge of the subframes. The slidable locking key keeps the subframes from falling out of the main frame.

It is possible to display the four subframes in the main frame even if all of the collector plates in the series are not mounted in the subframe. Under those circumstances a hole in the subframe reveals an attractive decorative background paper which is mounted on the inside back of the main frame. A metal name plate is preferably located at the bottom of the main frame and employed to generically identify the subframes and/or the name of the collection owner. A removable stand is attachable to the back of the main frame so that the multiframe display apparatus can be free standing. Alternatively, a bracket on the back of the main frame allows the multiframe apparatus to be hung from a nail or picture hook on the wall.

These and other features of the present invention will be understood by referring to the following drawings.

DETAILED DESCRIPTION OF THE PREFERRED EMBODIMENT

During the course of this description like numbers will be used to refer to like elements according to the different figures which illustrate the invention.

Figure 1:
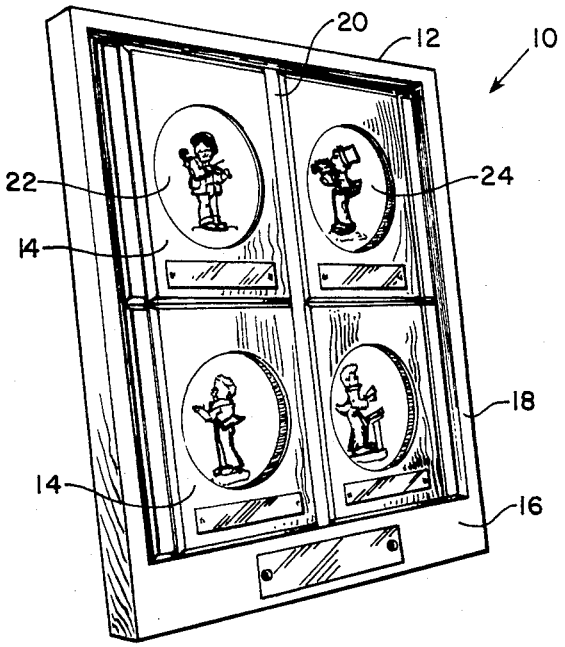
FIG. 1 is a front perspective view of the preferred embodiment of the invention.
Figure 2A:
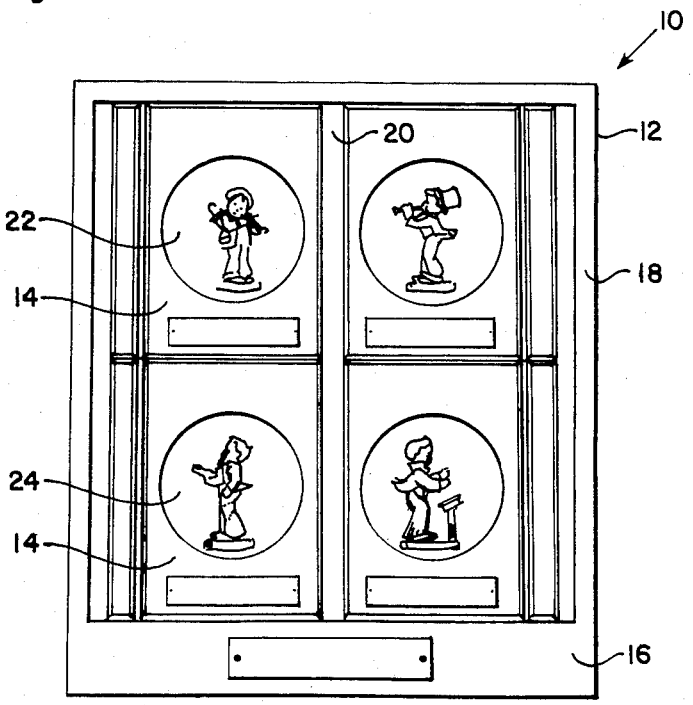
FIG. 2A is a front elevational view of the preferred embodiment of FIG. 1.
Figure 2B:
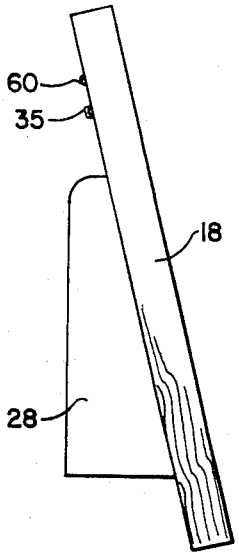
FIG. 2B is a left side elevational view of the preferred embodiment of FIG. 1.
Figure 2C:
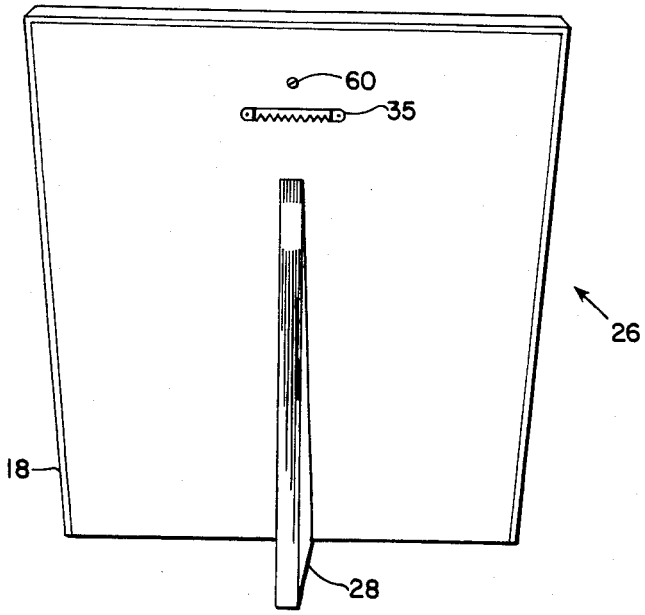
FIG. 2C is a rear elevational view of the preferred embodiment of FIG. 1.
Figure 2D:
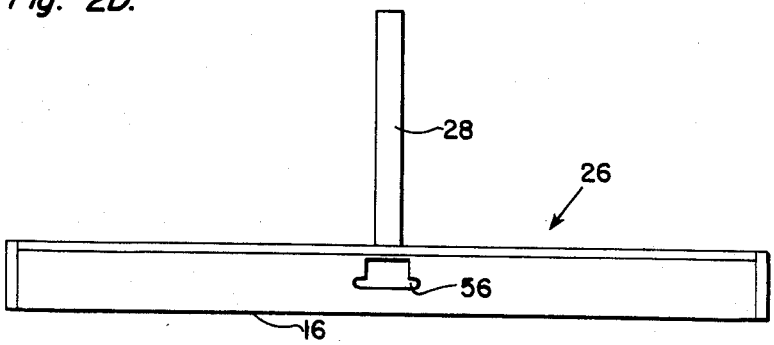
FIG. 2D is a bottom view of the preferred embodiment of the main frame showing the access hole for the locking key.
Figure 2E:
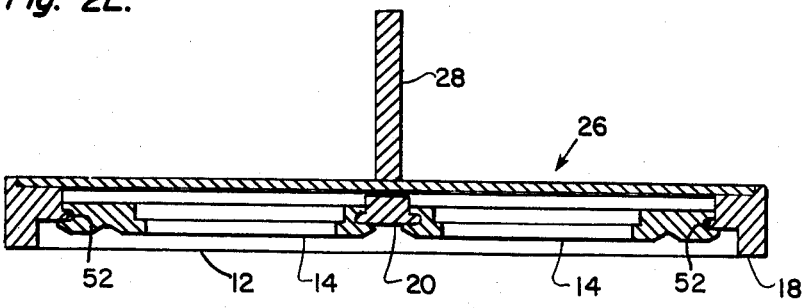
FIG. 2E is a cross-sectional view of the preferred embodiment of FIG. 1 showing the sliding locking key in the locking position.

A multiframe apparatus 10 according to the preferred embodiment of the invention is illustrated in FIG. 1. The multiframe invention 10 includes a main frame 12 and four subframes 14. The front side 16 of main frame 12 is circumscribed by framing material 18 around its edge. A sliding locking key member 20 separates the subframes 14 on the left from the subframes 14 on the right and serves to lock them securely into the structure of the main frame 12. Subframes 14 are primarily intended to display a small collector plate 22 such as the collector plates manufactured under the trademarks M. J. Hummel® or Goebel®. Collector plates 22 are frequently sold on an annual basis. Therefore, it could take several years before the four display fields of the subframes 14 are filled up. In order to maintain the attractive nature of the invention 10 a piece of decorative paper 24 is placed on the front facing portion of the back 26 of main frame 12. The decorative paper 24 could either be an abstract pattern, or, preferably, could be a picture of the image on the collector plate that has not yet been collected.

The main frame 12 is supported by a stand 28 that is selectively attachable to the back 26 of the invention 10. Stand 28 preferably includes two screw-like studs 30 having broad heads attached at points approximately 7" apart on stand 28. Screw studs 30 line up and mate with a pair of key holes 32 drilled in back 26. Therefore, the invention 10 can be made free standing by slipping screw studs 30 into keyholes 32 thereby affixing back stand 28 to main frame 12. Alternatively the invention 10 can be hung from a wall by placing hanging bracket 35 over a nail. The construction of hanging bracket 35 is believed to be conventional.

The front 36 of each subframe 14 is preferably solid and includes a decorative vertical stripe 38. A locking groove 40 circumscribes the edge of each subframe 14. The back 42 of each subframe 14 includes a hole 46 adapted to receive a removable stand 44. The removable stand 44 preferably comprises a short dowel selectively engagable with the bottom portion of the back 42. Alternatively, a longer dowel could be attached to a hole in the top of the subframe. A screw 50 attaches a spring metal clip 48 to the back 42. Spring clip 48 serves to hold the collector plate 22 in the display field of subframe 14. The sliding locking key 20 includes a pair of ribs 54 on each side thereof. The ribs engage the circumferential groove 40 when the key 20 is in position as shown in FIG. 1. The locking grooves 40 on the other edge of subframe 14 engage the ribs 52 located on the inside of the two vertical sides of the main frame 12. The engagement of groove 40 by ribs 52 and 54 hold the subframes 14 in the body of the main frame 12. Sliding locking key 20 is inserted into main frame 12 through a bottom access hole 56. A screw 60 is used to hold the sliding locking key 20 in place when ribs 52 and 54 are in engagement with groove 40.

Figure 3:
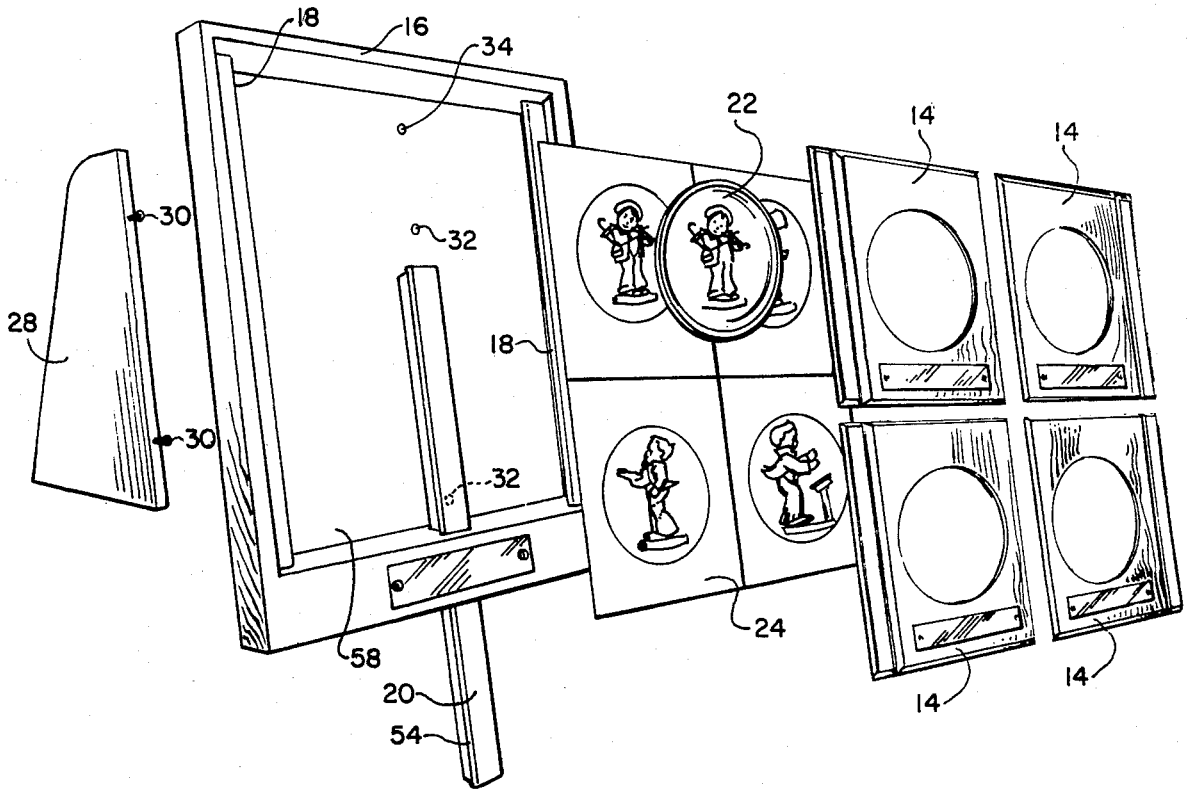
FIG. 3 is a partially exploded view of the preferred embodiment of the invention showing the manner in which the sliding locking key is placed in the main frame.
Figure 4A:
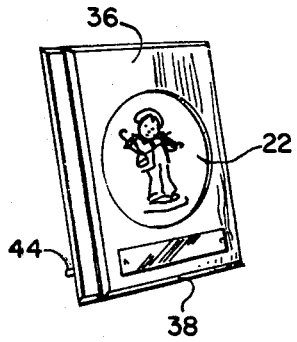
FIG. 4A is a front perspective view of an individual subframe in the free standing mode.
Figure 4B:
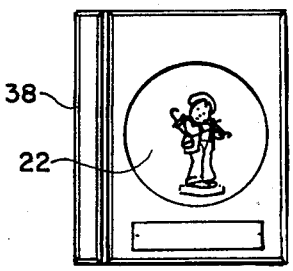
FIG. 4B is a front elevational view of the subframe of FIG. 4A.
Figure 4C:
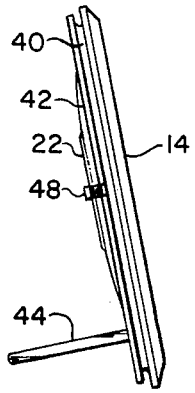
FIG. 4C is a left side elevational view of the subframe of FIG. 4A.
Figure 4D:
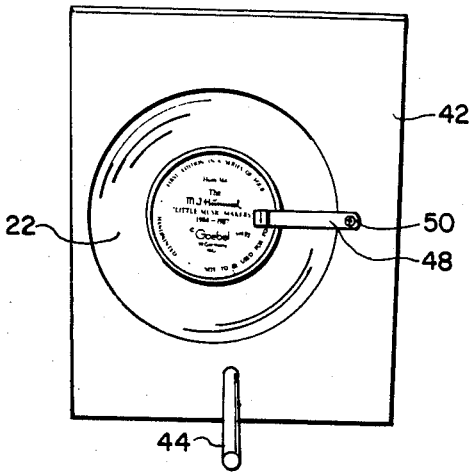
FIG. 4D is a rear elevational view of the subframe of FIG. 4A with the subframe stand in place and displaying a collector plate.
Figure 4E:
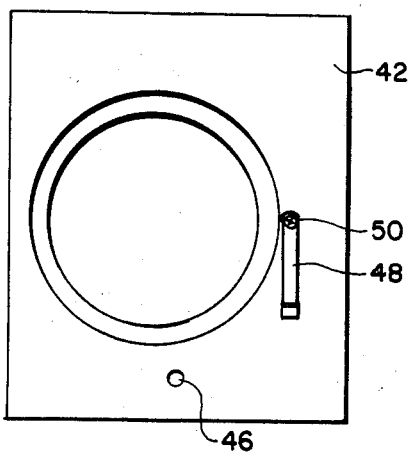
FIG. 4E is a rear view of the subframe of FIG. 4A with the subframe stand and the collector plate removed.

The subframes 14 are locked into the main frame 12 in the following manner. First, a collector plate 22, if available is placed into the subframes 14 and locked in position by spring metal clip 48. Second, the subframes 14 are arranged in an approximately square pattern as shown in the semi-exploded view of FIG. 3. Third, the outside grooves 40 of subframe 14 are engaged with engagement rib 52 on the vertical, interior, parallel sides of the main frame 12. Fourth, locking key 20 is slid through the bottom access hole 56 and into the open face 58 of main frame 12. In so doing the rib 54 on sliding locking key 20 engages the inward facing grooves 40 on the subframes 14. Fifth, the screw 60 is inserted into hole 34 and driven through the back 26 of main frame 12 and into the material of the sliding locking key 20. Screw 60 prevents the sliding locking key 20 from backing out of bottom access hole 56. Sixth, and lastly, the back stand 28 is attached to the two screw studs 30 and the multiframe apparatus 10 is placed in position for display. Alternatively, the multiframe apparatus can be hung by its bracket 35 from a nail on the wall.

According to the preferred embodiment of the invention the material of the main frame 12 and the subframes 14 comprise an attractive wood such as walnut. Alternatively other sorts of attractive woods or plastics might be used as well. In addition the invention 10 is described as displaying four subframes 14. While four subframes 14 are the preferred mode of practice of the invention 10, it is possible to display two subframes 14, or six, eight, ten, etc. subframes as long as the main frame 12 includes suitable display area 58 therein.

While the invention has been described with reference to the preferred embodiment thereof it will be appreciated by those of ordinary skill in the art that various modifications may be made to the structure of the parts and the materials employed in the invention without departing from the spirit and scope thereof.

We claim:

1. A frame apparatus comprising:
a plurality of subframes for displaying items;
a groove means on the periphery of said subframes;
a main frame for surrounding and supporting said subframes;
a hole in the back of said main frame;
a first rib means on the interior edge of said main frame for engaging said groove means in said subframes;
a locking means for holding said subframes in position in said main frame;
a second rib means on said locking means for engaging the groove means of said subframes;
an aperture means in said main frame for sliding said locking means into said main frame;
a keeper means for securing said locking means in said main frame after said locking means has been inserted into said aperture means,
wherein said keeper means comprises a screw means which is screwable into said locking means through said hole in the back of said main frame.

2. The apparatus of claim 1 wherein said locking means comprises a "T" shaped key having ribs on both sides thereof.

3. The apparatus of claim 2 further including:
a first stand means for supporting said main frame.

4. The apparatus of claim 3 further including:
a second stand means for supporting each of said subframes.

5. The apparatus of claim 4 further including:
a resilient clip means attached to the back of each subframe for holding a display item in said subframe.

6. The apparatus of claim 5 wherein said resilient clip means comprises a strip of springy metallic material.

7. The apparatus of claim 6 wherein said main frame includes at least two keyhole-like apertures in the back thereof and said first stand means includes at least two stud means each having a broad head and a narrow shank for engagement with said keyhole-like apertures.

8. The apparatus of claim 7 further including:
hanging means attached to said main frame for hanging said main frame on a wall.

9. The apparatus of claim 8 wherein said hanging means comprises a bracket having indentations for engaging with a nail-like projection from a wall.

10. A frame apparatus comprising:
a plurality of subframes for displaying items;
groove means on the periphery of said subframes;

a main frame for surrounding and supporting said subframes;

first rib means on the interior edge of said main frame for engaging said groove means of said subframes;

locking means for holding said subframes in said main frame, said locking means having a length at least as long as the longest edge of an individual subframe;

second rib means on said locking means for engaging the groove means of said subframes;

aperture means in said main frame for slidably receiving said locking means in said main frame;

keeper means for securing said locking means in said main frame after sliding said locking means into said aperture means, wherein said locking means comprises a single element that locks more than two subframes into said main frame.

* * * * *